US007926979B2

(12) United States Patent
Lai

(10) Patent No.: US 7,926,979 B2
(45) Date of Patent: Apr. 19, 2011

(54) ILLUMINATION DEVICE

(75) Inventor: Chih-Ming Lai, Miao-Li Hsien (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 337 days.

(21) Appl. No.: 12/251,705

(22) Filed: Oct. 15, 2008

(65) Prior Publication Data

US 2009/0231851 A1 Sep. 17, 2009

(30) Foreign Application Priority Data

Mar. 13, 2008 (CN) ..... 2008 1 0300552

(51) Int. Cl.
*F21V 29/00* (2006.01)

(52) U.S. Cl. ..... 362/253; 362/294

(58) Field of Classification Search ..... 362/253, 362/249.02, 294, 373
See application file for complete search history.

(56) References Cited

U.S. PATENT DOCUMENTS

2005/0156531 A1* 7/2005 Young ..... 315/112
2009/0205696 A1* 8/2009 Koester et al. ..... 136/201

* cited by examiner

*Primary Examiner* — David V Bruce
(74) *Attorney, Agent, or Firm* — Andrew C. Cheng

(57) ABSTRACT

An illumination device includes a light source module, a heat dissipating device and a heat conducting plate. The heat conducting plate is thermally coupled between the light source module and the heat dissipating device. In addition, the heat conducting plate includes a first contacting portion thermally contacting the light source module, and a second contacting portion thermally contacting the heat dissipating device. The thermal conductivity of the heat conducting plate in an extending direction from the first contacting portion to the second contacting portion is greater than that in a thickness-wise direction thereof.

17 Claims, 8 Drawing Sheets

ILLUMINATION DEVICE

CROSS-REFERENCE TO RELATED APPLICATIONS

This application is related to the following commonly-assigned copending applications: Ser. No. 12/206,171, entitled "ILLUMINATION DEVICE"; and Ser. No. 12/233,005, entitled "THERMOELECTRIC COOLER AND ILLUMINATION DEVICE USING SAME". Disclosures of the above-identified applications are incorporated herein by reference.

BACKGROUND

1. Field of the Invention

The present invention generally relates to illumination devices, and particularly to an illumination device with components thereof having flexibility in arrangement.

2. Description of Related Art

In recent years, due to excellent light quality and high luminous efficiency, light emitting diodes (LEDs) have increasingly been used to substitute for cold cathode fluorescent lamps (CCFL) as a light source of an illumination device, referring to "Solid-State Lighting: Toward Superior Illumination" by Michael S. Shur, or others on proceedings of the IEEE, Vol. 93, NO. 10 (October, 2005).

Light stability of the LEDs is affected by heat generated from the LEDs. When the temperature of the LEDs is too high, light intensity of the LEDs may gradually attenuate, shortening life of the illumination device. Thus, a thermoelectric cooler may be used to transfer heat from the LEDs to a heat dissipation device, from which the heat can be dissipated efficiently. However, in most conventional illumination devices, the LEDs are required to be arranged on a cool end of the thermoelectric cooler, and the heat dissipation device is required to be arranged on a hot end of the thermoelectric cooler, thus the LEDs and the heat dissipation device thermally contact the thermoelectric cooler. Such that the position relationships between the LEDs, the thermoelectric cooler and the heat dissipation device are difficult to be adjusted, and heat dissipation efficiency and appearance design of the illumination device are quite limited.

What is needed, therefore, is an illumination device with components thereof having flexibility in arrangement which can overcome the described limitations.

SUMMARY

An illumination device includes a light source module, a heat dissipating device and a heat conducting plate. The heat conducting plate is thermally coupled between the light source module and the heat dissipating device. In addition, the heat conducting plate includes a first contacting portion thermally contacting the light source module, and a second contacting portion thermally contacting the heat dissipating device. The thermal conductivity of the heat conducting plate in an extending direction from the first contacting portion to the second contacting portion is greater than that in a thicknesswise direction thereof.

Other advantages and novel features of the present thermoelectric cooler will become more apparent from the following detailed description when taken in conjunction with the accompanying drawings, in which:

BRIEF DESCRIPTION OF THE DRAWINGS

Many aspects of the present illumination device can be better understood with reference to the following drawings.

The components in the drawings are not necessarily drawn to scale, the emphasis instead being placed upon clearly illustrating the principles of the present illumination device. Moreover, in the drawings, like reference numerals designate corresponding parts throughout the several views.

DETAILED DESCRIPTION OF EMBODIMENTS

Figure 1:
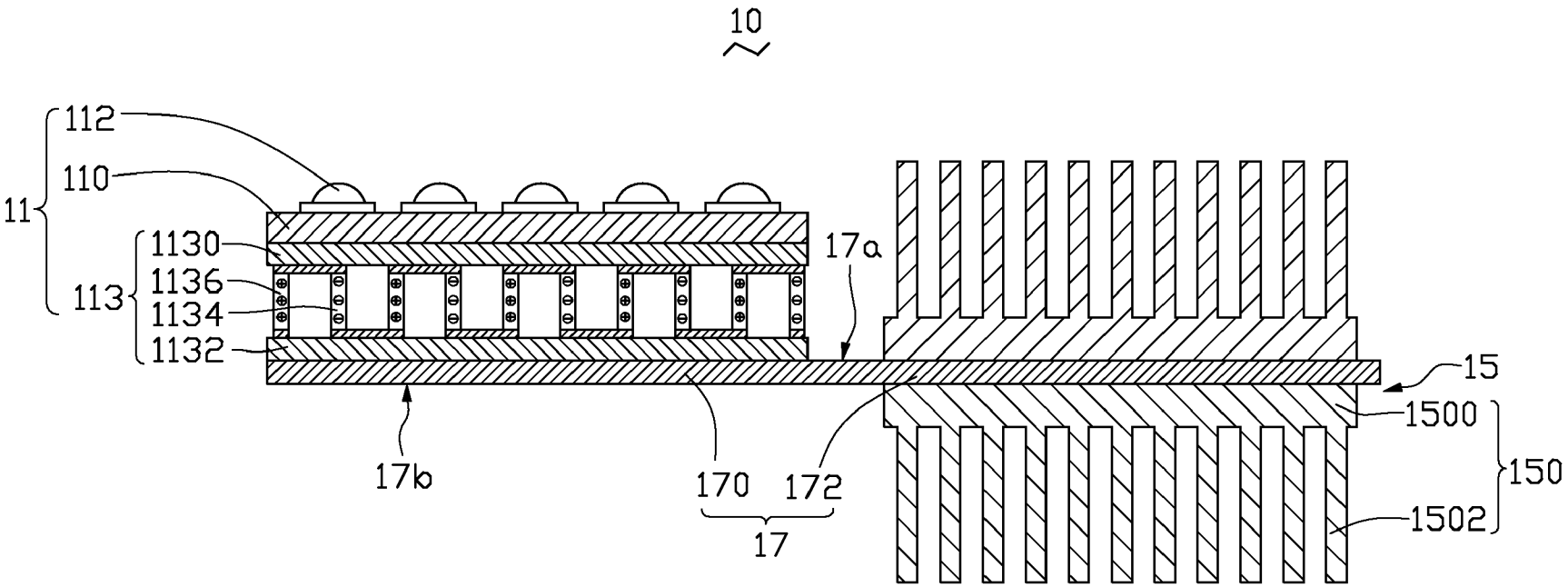
FIG. 1 is a cross-section of an illumination device, in accordance with a first embodiment.

Referring to FIG. 1, an illumination device 10, in accordance with a first embodiment, includes a light source module 11, a heat dissipation device 15 and a heat conducting plate 17.

The light source module 11 includes a circuit board 110, such as a printed circuit board, a plurality of solid-state light sources 112 mounted on the circuit board 110, and a thermoelectric cooler 113. The solid-state light sources 112 can be light emitting diodes (LED), such as white, red, green and blue LEDs.

The thermoelectric cooler 113 includes a cold end 1130, a hot end 1132, a plurality of N-type semiconductor elements 1134 and a plurality of P-type semiconductor elements 1136 sandwiched between the cold end 1130 and the hot end 1132. The cold end 1130 and the hot end 1132 are made of insulative material that has high heat conductivity, such as ceramic. The circuit board 110 thermally contacts the cold end 1130 of the thermoelectric cooler 113.

The heat dissipation device 15 includes two heat sinks 150. Each heat sink 150 includes a base 1500 and a plurality of fins 1502 extending from the base 1500.

The heat conducting plate 17 is thermally coupled to the light source module 11 and the heat dissipation device 15. As shown in FIG. 1, the heat conducting plate 17 is flat-shaped, and includes a first contacting portion 170 and a second contacting portion 172. The first contacting portion 170 and the second contacting portion 172 are arranged in a widthwise direction of the heat conducting plate 17. In addition, the first contacting portion 170 thermally contacts the hot end 1132 of the thermoelectric cooler 113, the second contacting portion 172 thermally contacts the bases 1500 of the heat sinks 150.

During operation, an power supply (not shown) having an anode and a cathode is applied to supply electric current to the thermoelectric cooler 113, wherein the N-type semiconductor elements 1134 is electrically connected to the anode, and the P-type semiconductor elements 1136 is electrically connected to the cathode. Heat is generated from the LEDs 112 during illumination. When the power supply supplies electric current to the thermoelectric cooler 113, electrons with negative electricity in the N-type semiconductor elements 1134 move to the anode, and holes with positive electricity in the P-type semiconductor elements 1136 move to the cathode. In such that, heat generated from the LEDs 112 can be transferred to the hot end 1132 from the cold end 1130 by electrical energy.

Figure 2:
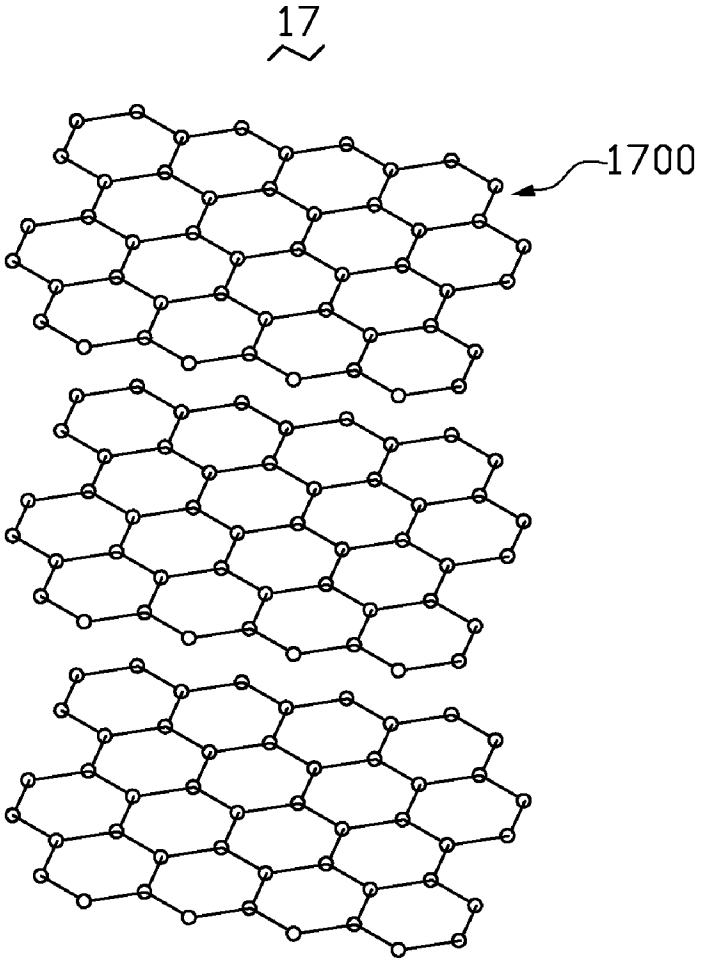
FIG. 2 is a molecular structure of a heat conducting plate of the illumination device in FIG. 1.

In the present embodiment, the heat conducting plate 17 is a carbonaceous layer. That is, the heat conducting plate 17 can be made of graphite, or carbonaceous composite, such as carbon mixed with metal, or others. In alternative embodiment, the heat conducting plate 17 is a vapor chamber extending from the first contacting portion 170 to the second contacting portion 172. A thermal conductivity in an extending direction from the first contacting portion 170 to the second contacting portion 172 is higher than that at a thicknesswise direction of the heat conducting plate 17. As shown in FIG. 2, the carbonaceous layer 17 is comprised of a plurality of laminated structures 1700 stacked one on another in the thicknesswise direction.

The thermal conductivity at a direction from the first contacting portion 170 to the second contacting portion 172 is greater than 800 W/mK. The heat conducting plate 17 includes a first side 17*a* and an opposing second side 17*b*. In arrangement of the thermoelectric cooler 113 and the two heat sinks 150, the thermoelectric cooler 113 thermally contacts the first side 17*a* of the first contacting portion 170, the two heat sinks 150 thermally contact the first and second side 17*a*, 17*b* of the second contacting portion 172, respectively.

The thermal conductivity in the extending direction from the first contacting portion 170 to the second contacting portion 172 is relatively high. Therefore, even if the heat dissipation device 15 is not arranged on the hot end 1132 directly to thermally contact the thermoelectric cooler 113, the heat accumulated on the hot end 1132 can be immediately dissipated via the heat conducting plate 17 to the heat sinks 150, from which the heat is dissipated in the air. In such that, efficiency of the heat dissipation of the LEDs 112 is improved, allowing the illumination device 10 operates continually within an acceptable temperature range to achieve stable optical performance.

Figure 3:
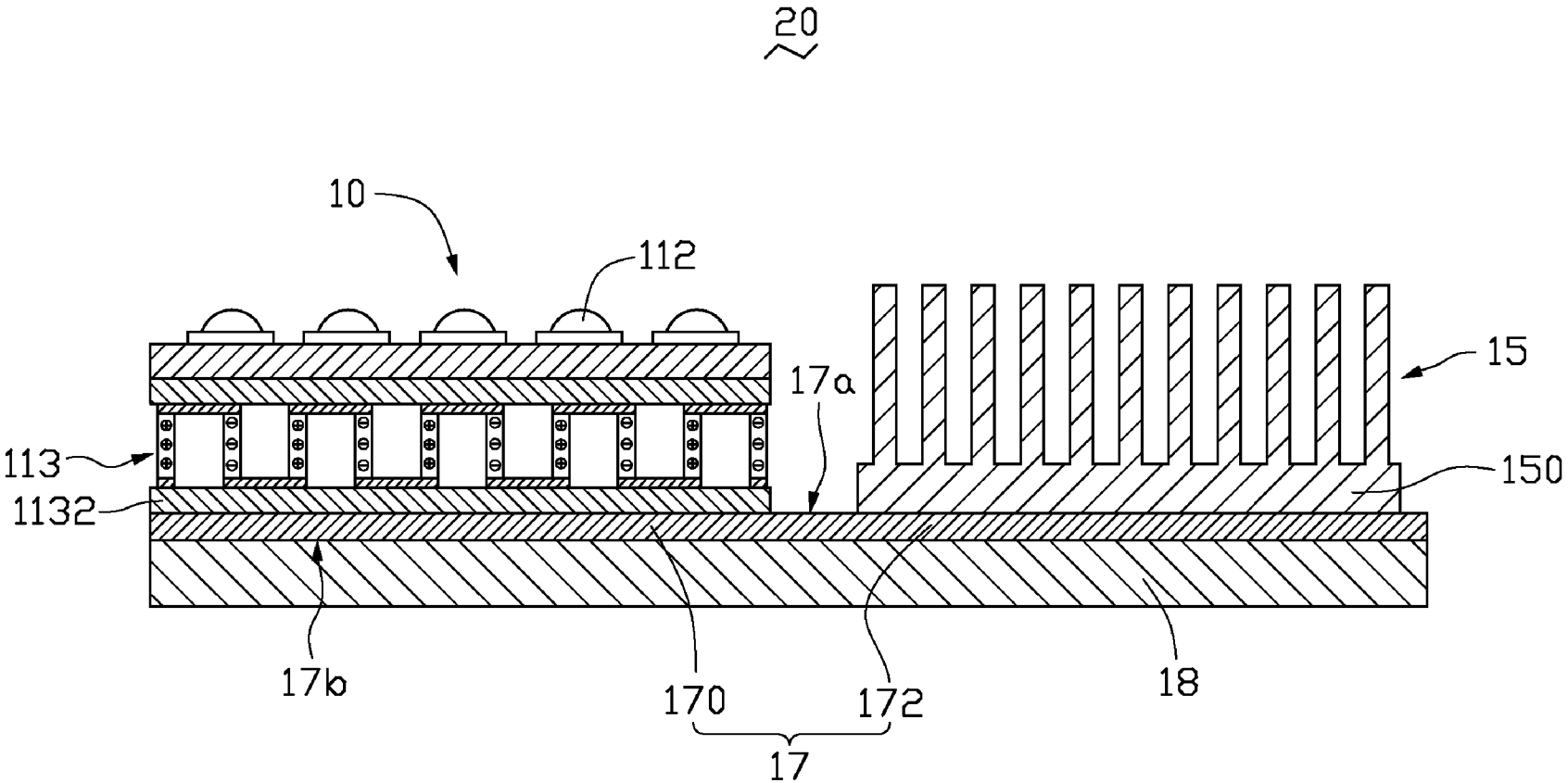
FIG. 3 is similar to FIG. 1, but shows a second embodiment of the illumination device employed in a street lamp.

In addition, the position of the heat dissipation device 15 will not be restrained by the thermoelectric cooler 113, thus application range of the illumination device 10 is expanded. For example, as shown in FIG. 3, the illumination device 10, in accordance with a second embodiment, generally can be employed in a street lamp 20. The heat dissipation device 15 of the illumination device 10 includes only a heat sink 150 thermally contacting the first side 17*a* of the second contacting portion 172. The street lamp 20 includes a shell 18 to protect the illumination device 10. The shell 18 is exposed in the air, and can be made of heat conducting material, such as metal, to be thermally coupled to the illumination device 10 on the second side 17*b* of the heat conducting plate 17. Therefore, heat accumulated on the hot end 1132 of the thermoelectric cooler 113 can be immediately dissipated via the heat conducting plate 17 to both the heat sinks 150 and the shell 18, from which the heat is dissipated in the air.

Figure 4:
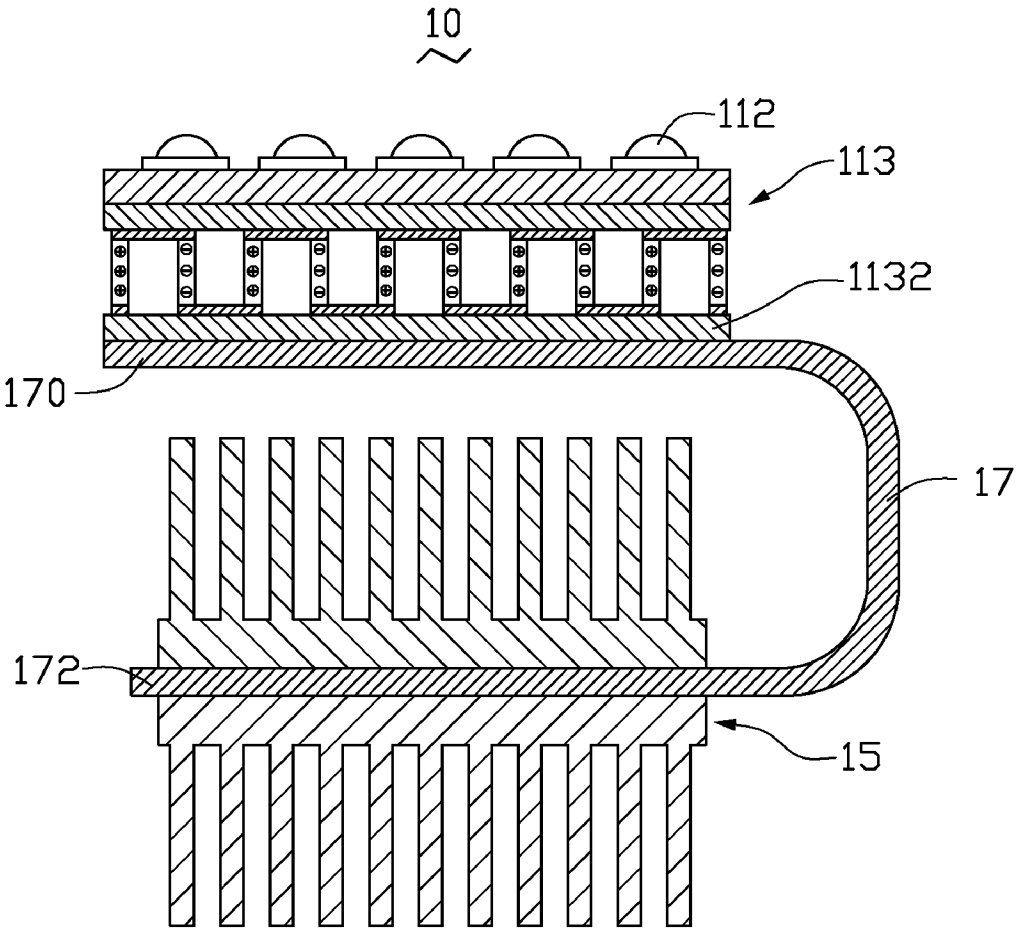
FIG. 4 is similar to FIG. 1, but shows a third embodiment of the illumination device.

Preferably, the heat conducting plate 17 can be flexible. Thus, the position relationship of the LEDs 112, the heat dissipation device 15 and the thermoelectric cooler 113 can be more flexible. As shown in FIG. 4, the illumination device 10, in accordance with a third embodiment, differs from the illumination device 10 of the first embodiment in that the first contacting portion 170 of the heat conducting plate 17 is parallel with the second contacting portion 172 thereof, and the heat dissipation device 15 is positioned opposite to the thermoelectric cooler 113 far away from the LEDs 112. The heat accumulated on the hot end 1132 can also be immediately dissipated via the heat conducting plate 17 to the heat dissipation device 15.

Furthermore, it can be understood, that an area of the heat conducting plate 17 is desired according to practical applications, and should not be limited by the embodiments. For example, the area of the heat conducting plate 17 can be large enough, to allow arrangement of more heat sinks 150 thereon to achieve better efficiency of heat dissipation.

Figure 5:
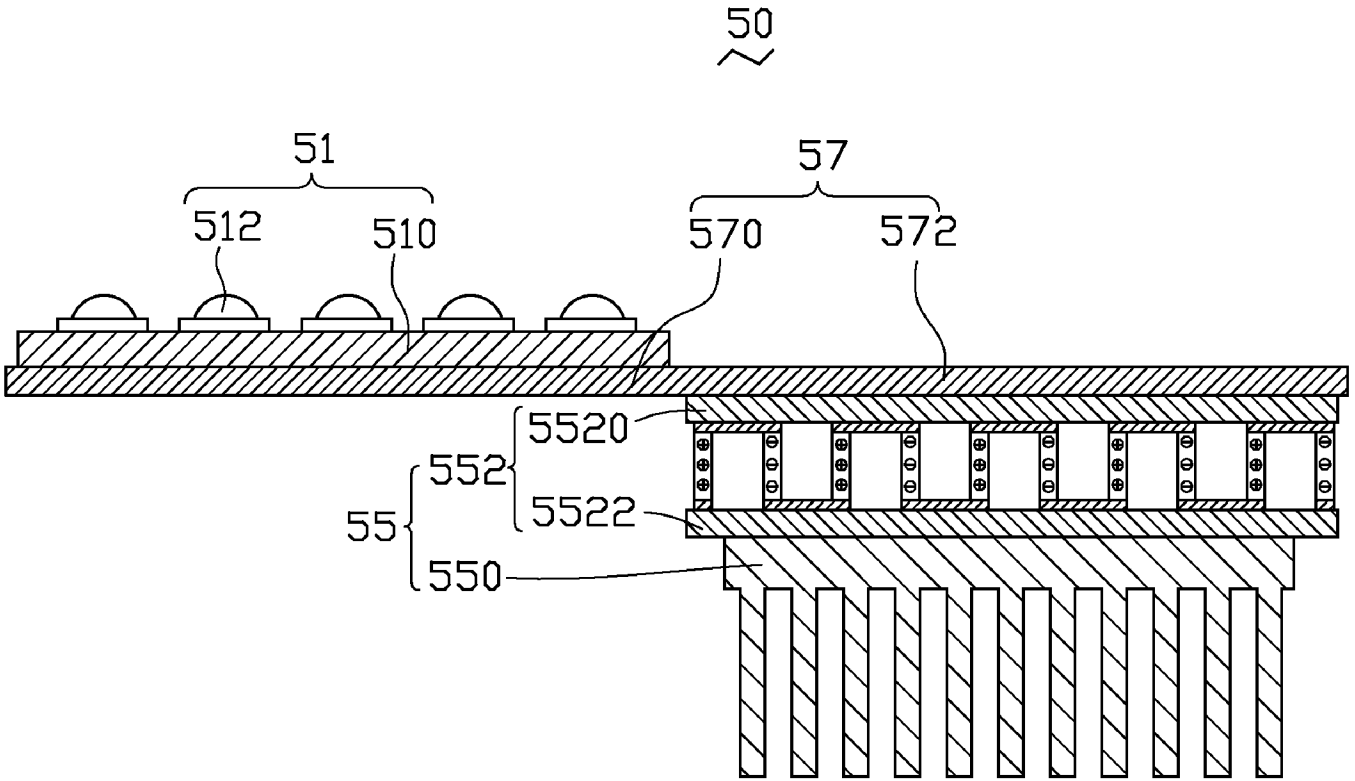
FIG. 5 is a cross-section of an illumination device, in accordance with a fourth embodiment.

FIG. 5 shows an illumination device 50, in accordance with a fourth embodiment, differing from the illumination device 10 of the first embodiment is that the light source module 51 includes only a circuit board 510 and LEDs 512 mounted thereon, and the heat dissipation device 55 includes both a thermoelectric cooler 552 and a heat sink 550. The circuit board 510 thermally contacts the first contacting portion 570 of the heat conducting plate 57. The cold end 5520 of the thermoelectric cooler 552 thermally contacts the second contacting portion 572 of the heat conducting plate 57. The hot end 5522 of the thermoelectric cooler 552 thermally contacts the heat sink 550 directly.

Figure 6:
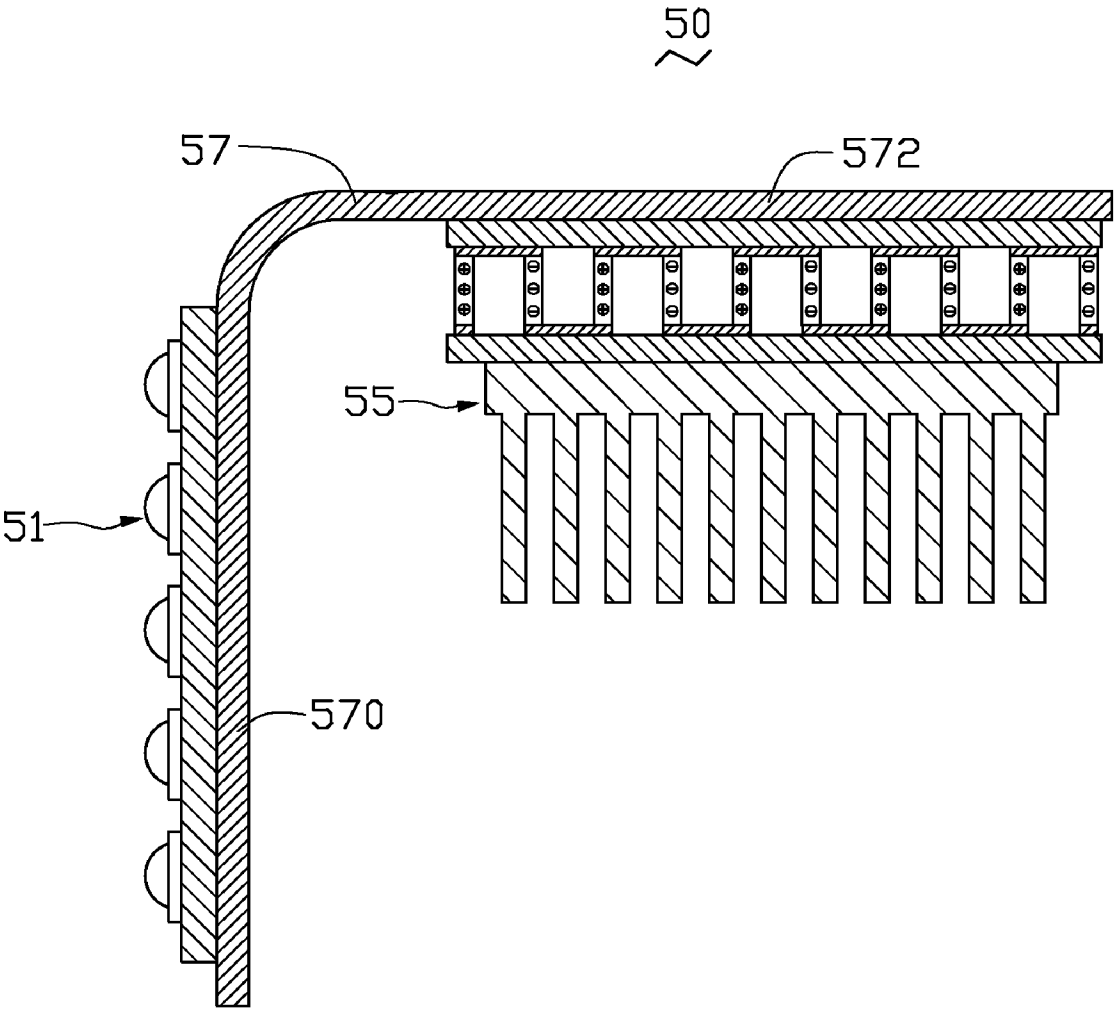
FIG. 6 is similar to FIG. 5, but shows a fifth embodiment of the illumination device.

Preferably, the heat conducting plate 57 of the illumination device 50 also can be flexible. As shown in FIG. 6, the illumination device 50, in accordance with a fifth embodiment, differing from the illumination device 50 of the fourth embodiment in that the first contacting portion 570 of the heat conducting plate 57 is perpendicular to the second contacting portion 572 thereof. Therefore, the illumination device 50 has good flexibility in arrangement of the position relationship between the light source module 51 and the heat dissipation device 55.

Figure 7:
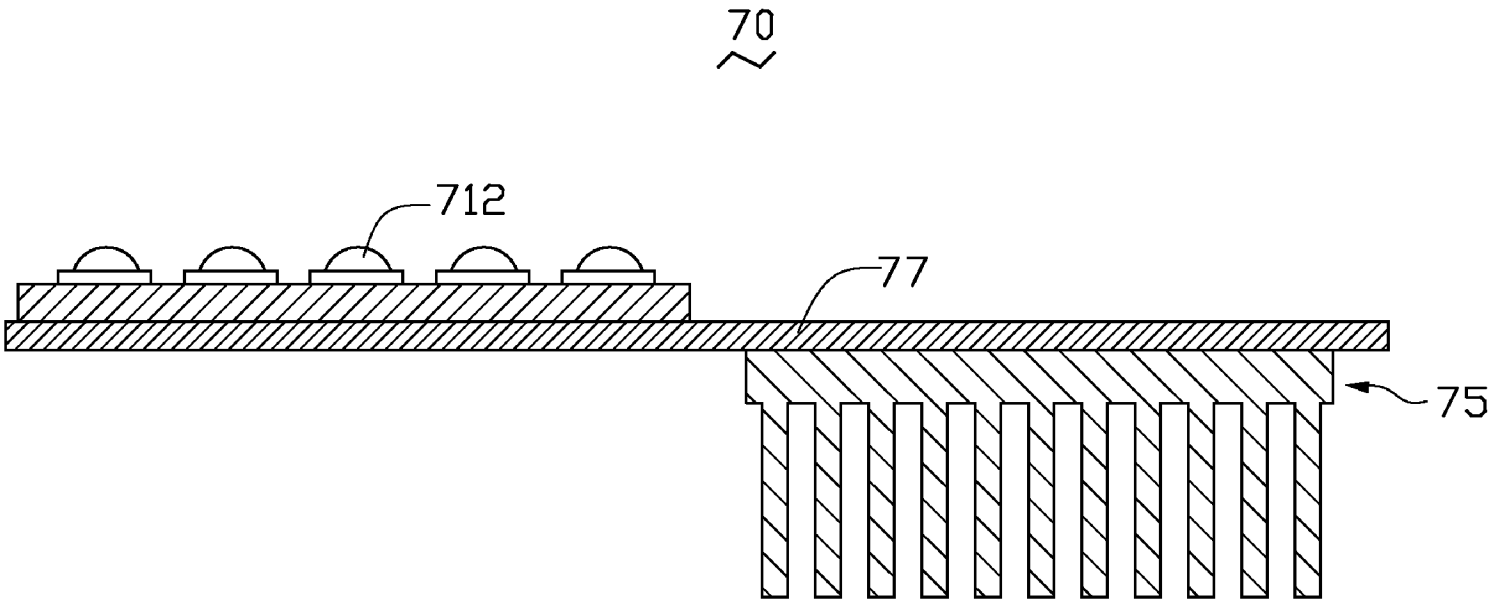
FIG. 7 is a cross-section of an illumination device, in accordance with a sixth embodiment.

FIG. 7 shows an illumination device 70, in accordance with a sixth embodiment. The illumination device 70 is distinguished from the illumination device 50 of fourth embodiment in that the thermoelectric cooler 552 is absent. Heat generated by the LEDs 712 can also be transmitted to the heat dissipation device 75 via the heat conducting plate 77.

Figure 8:
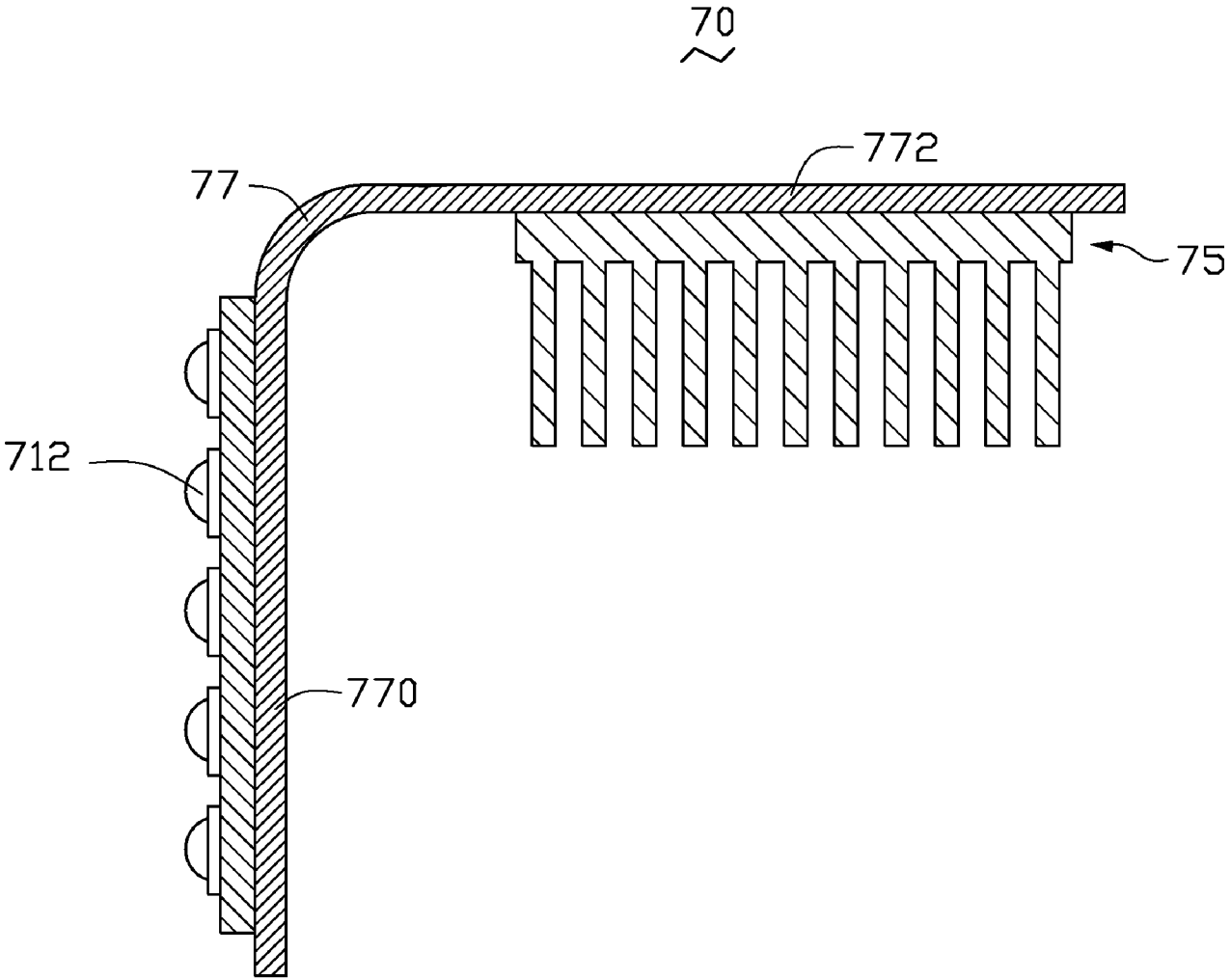
FIG. 8 is similar to FIG. 7, but shows a seventh embodiment of the illumination device.

Preferably, the heat conducting plate 77 of the illumination device 70 also can be flexible. As shown in FIG. 8, the illumination device 70, in accordance with a seventh embodiment, differing from the illumination device 70 of the sixth embodiment in that the first contacting portion 770 of the heat conducting plate 77 is perpendicular to the second contacting portion 772 thereof.

It is believed that the present invention and its advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An illumination device, comprising:

a light source module;

a heat dissipating device; and a heat conducting plate thermally coupled between the light source module and the heat dissipating device, the heat conducting plate comprising a first contacting portion thermally contacting the light source module, and a second contacting portion thermally contacting the heat dissipating device, a thermal conductivity of the heat conducting plate in an extending direction from the first contacting portion to the second contacting portion being greater than that in a thicknesswise direction thereof, the first contacting portion of the heat conducting plate being distinctly oriented from the second contacting portion thereof.

2. The illumination device of claim 1, wherein the heat dissipation device comprises a heat sink, the heat sink comprises a base and a plurality of fins extending from the base, the light source module comprising a thermoelectric cooler having a hot end, the base of the heat sink thermally contacting the hot end of the thermoelectric cooler.

3. The illumination device of claim 1, wherein the light source module comprises a circuit board and a solid-state light source mounted on the circuit board, and the circuit board thermally contacts the first contacting portion of the heat conducting plate.

4. The illumination device of claims 3, wherein the solid-state light source includes a light emitting diode.

5. The illumination device of claim 3, wherein the heat dissipation device comprises a heat sink, the light source module comprises a thermoelectric cooler, the thermoelectric cooler comprises a cold end and an opposing hot end, the cold end thermally contacts the second contacting portion of the heat conducting plate, and the hot end thermally contacts the heat sink of the heat dissipation device.

6. The illumination device of claim 1, wherein the light source module comprises a circuit board, a solid-state light source mounted on the circuit board and a thermoelectric cooler, the thermoelectric cooler comprises a cold end and an opposing hot end, the cold end thermally contacts the circuit board, and the hot end thermally contacts the first contacting portion of the heat conducting plate.

7. The illumination device of claims 6, wherein the solid-state light source includes a light emitting diode.

8. The illumination device of claim 1, wherein the heat conducting plate includes a carbonaceous layer, and the carbonaceous layer is comprised of a plurality of laminated structures stacked one on another in the thicknesswise direction.

9. The illumination device of claim 1, wherein the heat conducting plate includes a vapor chamber extending from the first contacting portion to the second contacting portion.

10. The illumination device of claim 1, wherein the heat conducting plate is flexible.

11. The illumination device of claim 1, wherein the first contacting portion of the heat conducting plate is perpendicular to the second contacting portion thereof.

12. The illumination device of claim 1, wherein the first contacting portion of the heat conducting plate includes a first surface in thermal contact with the light source module, and an opposing exposed second surface free of the heat dissipating device mounted thereon.

13. An illumination device, comprising:

a light source module;

a heat dissipating device; and a heat conducting plate comprising a first contacting portion thermally contacting the light source module and a second contacting portion thermally contacting the heat dissipating device, the first contacting portion and the second contacting portion being arranged in a widthwise direction or a lengthwise direction of the heat conducting plate, a thermal conductivity of the heat conducting plate in at least one of the widthwise direction and the lengthwise direction being greater than that in a thicknesswise direction of the heat conducting plate;

wherein the first contacting portion of the heat conducting plate includes a first surface in thermal contact with the light source module, and an opposing exposed second surface free of the heat dissipating device mounted thereon.

14. The illumination device of claim 13, wherein the heat conducting plate includes a carbonaceous layer, and the carbonaceous layer is comprised of a plurality of laminated structures stacked one on another in the thicknesswise direction.

15. The illumination device of claim 13, wherein the heat conducting plate includes a vapor chamber extending from the first contacting portion to the second contacting portion.

16. The illumination device of claim 13, wherein the heat conducting plate is flexible.

17. The illumination device of claim 13, wherein the first contacting portion of the heat conducting plate is perpendicular to the second contacting portion thereof.

* * * * *